US007984683B1

(12) United States Patent
Hupy

(10) Patent No.: US 7,984,683 B1
(45) Date of Patent: Jul. 26, 2011

(54) COMPOUND DISPLACEMENT WAVE FORM HULL DESIGN FOR GREEN VESSELS

(76) Inventor: Guy M. Hupy, Port Townsend, WA (US)

( * ) Notice: Subject to any disclaimer, the term of this patent is extended or adjusted under 35 U.S.C. 154(b) by 183 days.

(21) Appl. No.: 12/237,995

(22) Filed: Sep. 25, 2008

Related U.S. Application Data

(60) Provisional application No. 60/977,824, filed on Oct. 5, 2007.

(51) Int. Cl.
*B63B 1/00* (2006.01)

(52) U.S. Cl. ..... 114/271

(58) Field of Classification Search ..... 114/271, 114/56.1, 61.26–61.33
See application file for complete search history.

(56) References Cited

U.S. PATENT DOCUMENTS

| | | | | |
|---|---|---|---|---|
| 998,437 | A | 7/1911 | Wieland | |
| 1,980,114 | A | 11/1934 | Taylor | |
| 3,091,206 | A | 5/1963 | Cale | |
| 3,303,809 | A | 2/1967 | Ross | |
| 3,707,936 | A * | 1/1973 | Harris | 114/285 |
| 3,808,999 | A | 5/1974 | Peterson | |
| 4,022,143 | A | 5/1977 | Krenzler | |
| 4,027,613 | A | 6/1977 | Wollard | |
| 4,040,373 | A | 8/1977 | Jones, Jr. | |
| 4,128,072 | A | 12/1978 | Wood, Jr. | |
| 4,193,370 | A | 3/1980 | Schoell | |
| 4,538,538 | A | 9/1985 | Carbonel | |
| 5,125,352 | A | 6/1992 | Shields | |
| 5,419,274 | A | 5/1995 | van Diepen | |
| 5,701,835 | A * | 12/1997 | Børseth | 114/61.27 |
| 6,604,478 | B2 * | 8/2003 | Barsumian | 114/67 A |
| 6,994,049 | B1 | 2/2006 | Schulz | |

FOREIGN PATENT DOCUMENTS

| | | |
|---|---|---|
| GB | 2347115 A1 | 8/2000 |
| JP | 0585698 A1 | 9/1994 |
| JP | 8133172 B1 | 5/1996 |

OTHER PUBLICATIONS

"A boat that does not produce waves", Press Release, Alpe Adria Magazin, Feb. 6, 2002, www.alsphere.at/press/artikel_01.php.

* cited by examiner

*Primary Examiner* — Daniel Venne
(74) *Attorney, Agent, or Firm* — Jacques M. Dulin, Esq.; Innovation Law Group, Ltd.

(57) ABSTRACT

Compound hull for electric-powered, cruiser-type vessels having a unique hard chine displacement wave form hull that recycles wave energy to minimize drag and results in lowered power requirements for long-period cruising at displacement hull speeds. The inventive hull comprises: 1) an upper hull portion having a flat bottom square transom, the bottom curve of the hull sides of which match the vessel's wave form at hull speed, mated to, 2) a bottom hull portion formed as a double ended V-bottom lower displacement hull having a constant varying dead-rise. The inventive hull requires up to 50% less power than conventional cruisers of other hull shapes, at displacement hull speed.

18 Claims, 10 Drawing Sheets

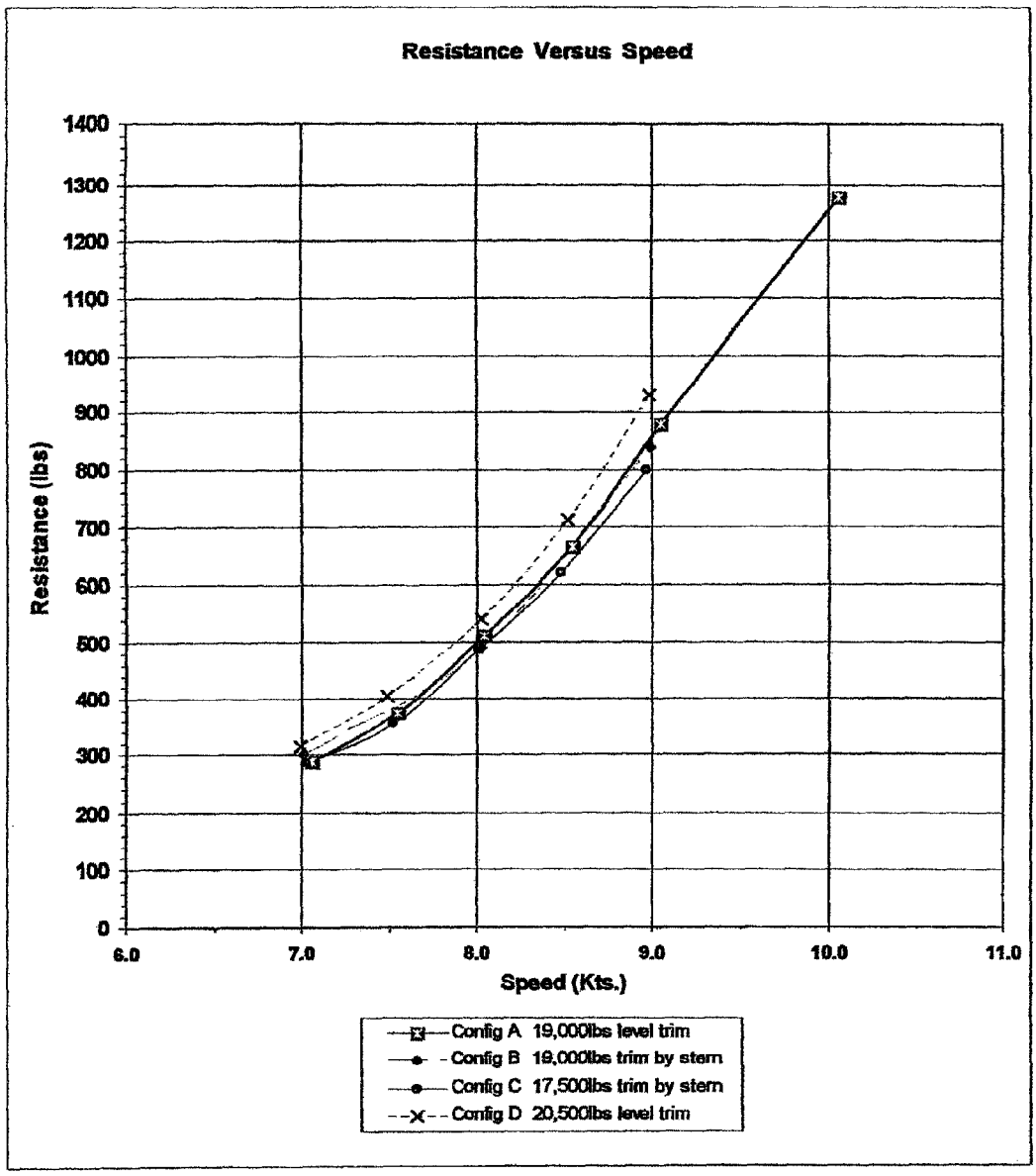
Figure 9: Total Resistance versus Speed

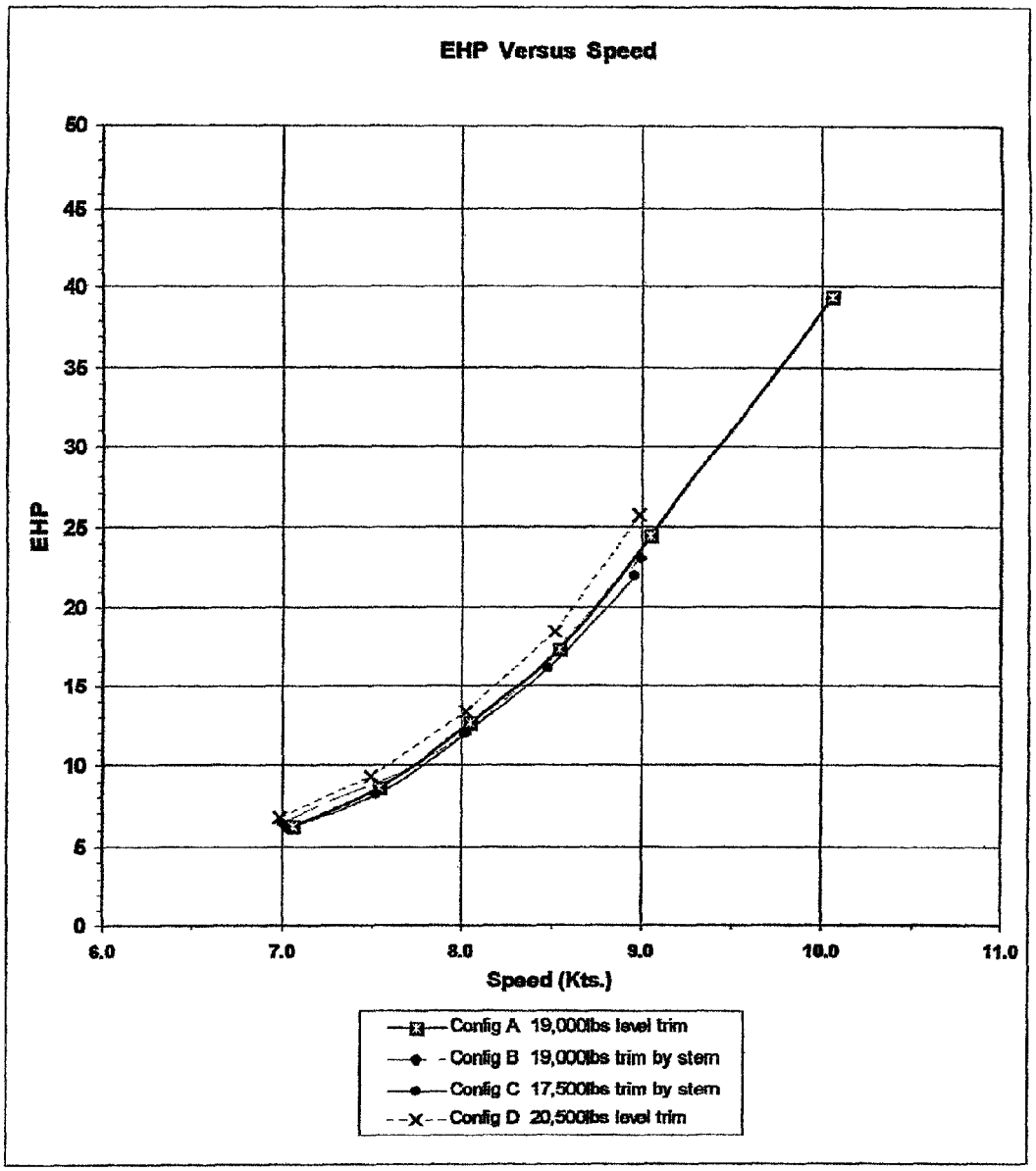
Figure 10: EHP versus Speed

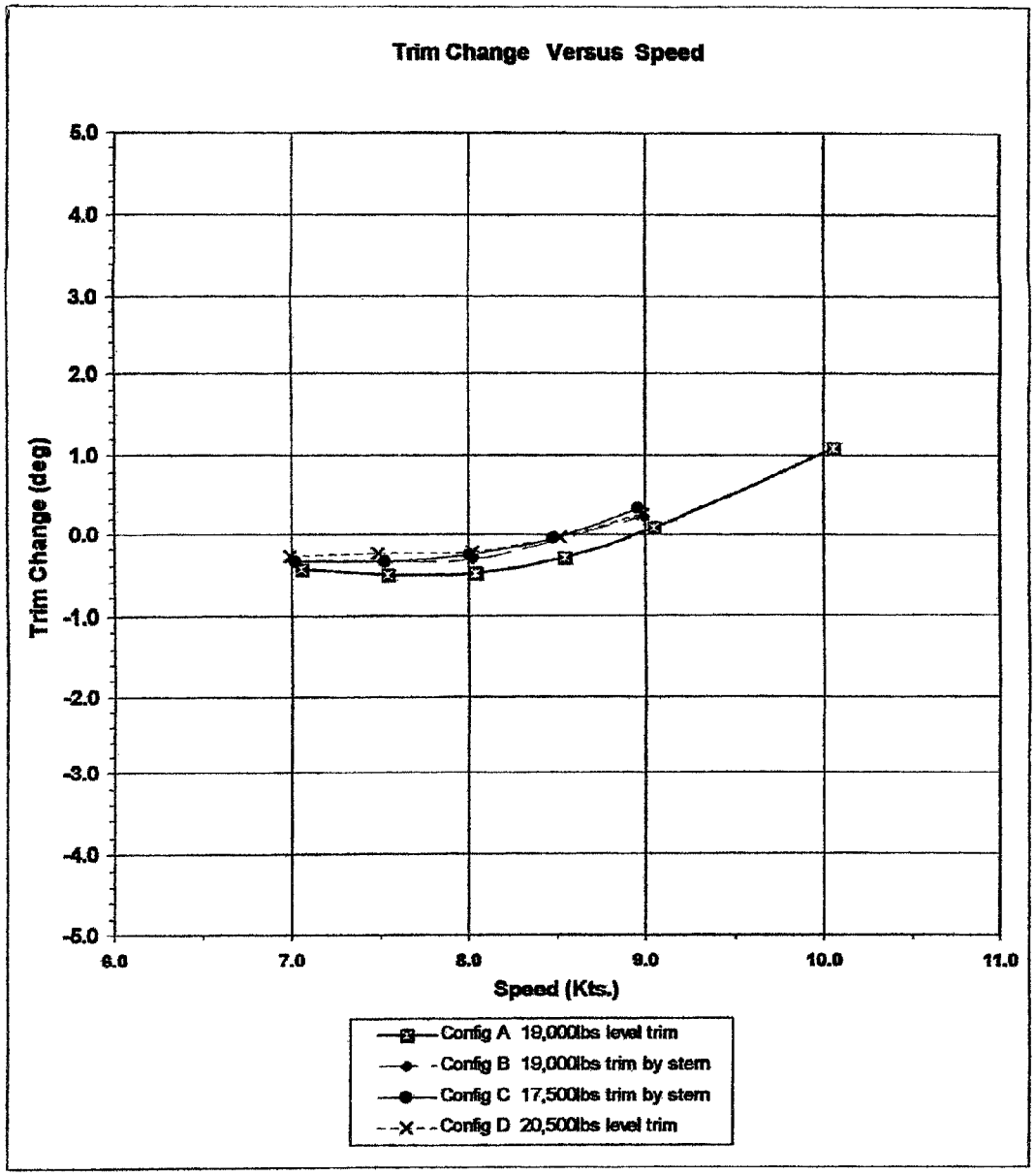
Figure 11: Trim Change versus Speed

COMPOUND DISPLACEMENT WAVE FORM HULL DESIGN FOR GREEN VESSELS

CROSS-REFERENCE TO RELATED APPLICATION

This Application is the Regular US Patent Application corresponding to Applicant's prior U.S. Provisional Application S. N. 60/977,824 filed under the title Displacement Wave Form Hull Design For Green Vessels on Oct. 5, 2007, the priority of which US Provisional Application is claimed under 35 US Code §§119, 120, ff, and the entire subject matter of which is hereby incorporated by reference.

FIELD

The invention relates to hull designs, and more particularly to compound hull designs for electric-powered, green, cruiser-type vessels having a unique hard chine displacement wave form hull that recycles wave energy to minimize drag and results in lower power requirements for long-period cruising at displacement hull speeds. The inventive compound hull comprises a two part hull of: A., a flat-bottom, square transom, upper hull portion having its side wall chine curved to match the vessel's wave form at hull speed; mated at its bottom to B., a double-ended, V-bottom, lower displacement hull portion having a constant varying deadrise.

BACKGROUND

As part of the world-wide interest in alternate power sources, some consideration has been given to electric-powered propulsion systems for vessels. Batteries as electric storage devices have some advantage as being relatively small unit size and relatively easily securely mountable. As such they can serve not only as power reservoirs but also as ballast, a requirement for vessel stability.

However, batteries must constantly be recharged, and the power capacity does not match the energy density of gasoline. For example, gasoline has an energy density around 14, while lead-acid batteries are around 3. Nevertheless, as compared to larger engines directly powering the screw, hybrid designs comprising a small diesel engine powering a generator for the purpose of recharging the batteries poses potential for recreational motor cruisers.

For electric, or hybrid electric/small engine-powered motor cruisers, the critical limitation is hull drag. For a gasoline or diesel-powered ship engine, the energy density of the fuel is such that low drag hull design is less of a consideration than accommodations, amenities and speed.

For a cruising yacht to function effectively under electric power, it must be highly efficient, seaworthy, stable, and comfortable. A double ended hull form would meet the first two criteria admirably. However, narrow, un-ballasted hulls typically have low load capacity and roll readily and uncomfortably. Further, they do not provide dockside stability that is required for useful cruiser design to be accepted by discriminating owners and users. In addition, accommodations suffer due to lack of beam, a double-ender typically being notoriously narrow. Finally, the fine (sharp or pointed) prow and stern ends, while good for wave piercing, do not dampen pitching very well during cruising.

Accordingly, there is a need in the art for a cruiser hull design that is highly power efficient so that it may be fitted with hybrid electric/small engine, or all electric power sources, yet provides ample beam for accommodations, while being stable, both dockside for boarding and disembarking and during cruising, resists roll and pitch yet cruises at an acceptable speed.

THE INVENTION

Summary, Including Objects and Advantages

The invention fills the need in the art, being directed to hull designs, and more particularly to hull designs for electric-powered, green, bridge deck cruiser-type vessels having a unique hard chine displacement wave form hull that recycles wave energy to minimize drag and results in lower power requirements for long-period cruising at displacement hull speeds, as compared to conventional cruiser hull shapes while offering both dockside and cruising stability with ample beam for accommodations and load capacity.

The inventive hull comprises a compound two-part hull having a fore end, an aft end, a mid-ship line, the parts of the compound hull being: A. an upper hull portion, mated to B. a lower hull portion. The upper hull portion, A, comprises a generally flat-bottom portion aft of the mid-ship line to the stern, a square transom form, the chine of the hull sides of which follows a curve which matches the vessel's wave form at hull speed. The lower (or bottom) hull portion, B, comprises a pair of angled sides joined continuously along a bottom keel margin from a forward end to an aft end of the vessel which together form a double-ended, V-bottom, displacement hull having a constant varying dead-rise angle. The two hull portions are mated along the bottom of the upper hull portion. The inventive hull requires less power than cruisers having conventional hull shapes.

In the inventive compound hull, the lower V-bottom hull portion is configured to carry 75% of the vessel displacement. Its constant varying deadrise angle provides an efficient entry angle for minimal resistance while directing hydrodynamic flow cleanly aft to the propeller area. This double ended V-hull form is very efficient at speeds up to 1.3 times the square root of the water line, (hull speed for the vessel beam-to-length ratio). As the hull reaches the hull speed, a wave form the length of the water line is created in the water with its hollow amid-ships. The upper hull portion, with its flat, horizontal after-planes rides on the surface of the forward-facing, aft-to-mid-ship, downhill portion of this wave, thereby riding downhill. That is, the crest of the wave formed by the hull is under the transom of the upper hull portion. As a result, the upper hull is "surfing" by recapturing the wave-making energy of the propulsion system. The upper hull portion flat, horizontal, transom bottom also creates an end plate effect on upward flowing wake turbulence off the lower hull. This dampens the wake and further reduces energy-robbing turbulence.

Accordingly, the inventive composite hull design meets the requirements for cruising yachts to function effectively under electric or hybrid electric/small IC engine power, in that it is efficient, seaworthy, stable, and comfortable. The double-ended lower hull portion meets the first two criteria, and creates a smooth, efficient wave form. The flat bottom of the upper hull portion, extending between the lower hull portion upper edge and the chine line of the upper hull portion, resists roll and dampens pitch, overcoming the limitation of uncomfortable pure double-ended hull design, and also provides the dockside stability that is required. In addition, the wider, flat-bottom, square stern, upper hull portion provides sufficient beam to permit full accommodations to be fitted in the vessel. The flat aft-plane sections of the upper hull bottom remedy the pitch and roll defects in the double-ended hull design. The reduction in wave form drag offsets the additional surface area drag created by the upper hull surface.

Any suitable superstructure and interior cabin and amenities layout following accepted nautical architectural principles for balance, functionality, safety and seaworthiness may be fitted to a hull employing the inventive compound design. A wide range of power plant sizes may be used. A hull in accord with the principles of the invention may be specifically designed for a target vessel speed when the upper hull portion is designed to match the wave form created by the lower, double ended V-bottom lower hull portion at displacement hull speed. Thus for a 40' vessel, the displacement speed with a standard Cruising Load of 1500 lbs (2 persons, gear and full fuel and water tankage) is 8 knots. For a 50' vessel at such a Cruising Load the speed is 9 knots. The 40' vessel can reach performance specifications at an unexpectedly low 20 hp, as compared to conventional cruiser designs requiring on the order of 40 hp.

BRIEF DESCRIPTION OF THE DRAWINGS

The invention is described in more detail with reference to the drawings, in which:

FIG. 6 is a series of three line drawings showing the model of FIG. 4 in the test tank at load; in which

FIG. 7 is a series of three line drawings showing the model of FIG. 4 in the test tank running light (unloaded); in which

FIG. 8 is a series of three line drawings showing the model of FIG. 4 in the test tank running heavy (overloaded); in which

FIG. 9 is a graph of Total Resistance vs Speed for four different test configurations of the inventive compound hull design;

FIG. 10 is a graph of Effective Horsepower (EHP) vs Speed for the four different test configurations of the inventive compound hull design; and FIG. 11 is a graph of Trim Change vs Speed for four different test configurations of the inventive compound hull design.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

As used herein, Displacement Hull Speed is defined as: The speed at which the wave form created by a given hull form is equal in length to the waterline length (generally at a speed/length ratio of 1.3 ($V/\sqrt{L}$) where V=velocity and L=waterline length.

Figure 1:
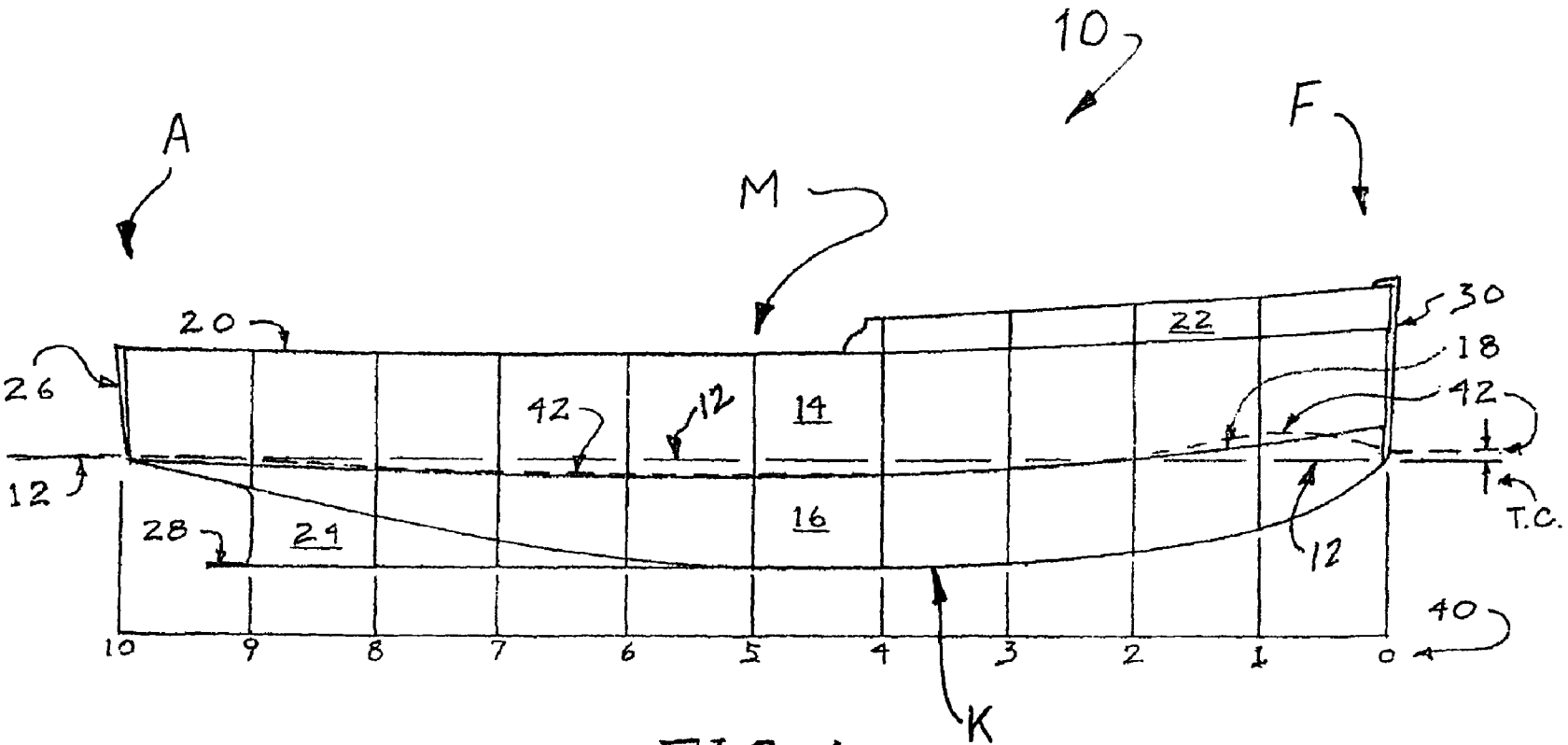
FIG. 1 is a Lines Plan, scaled drawing of the inventive compound displacement wave form hull in profile, configured as a 40' cruiser.
Figure 2:
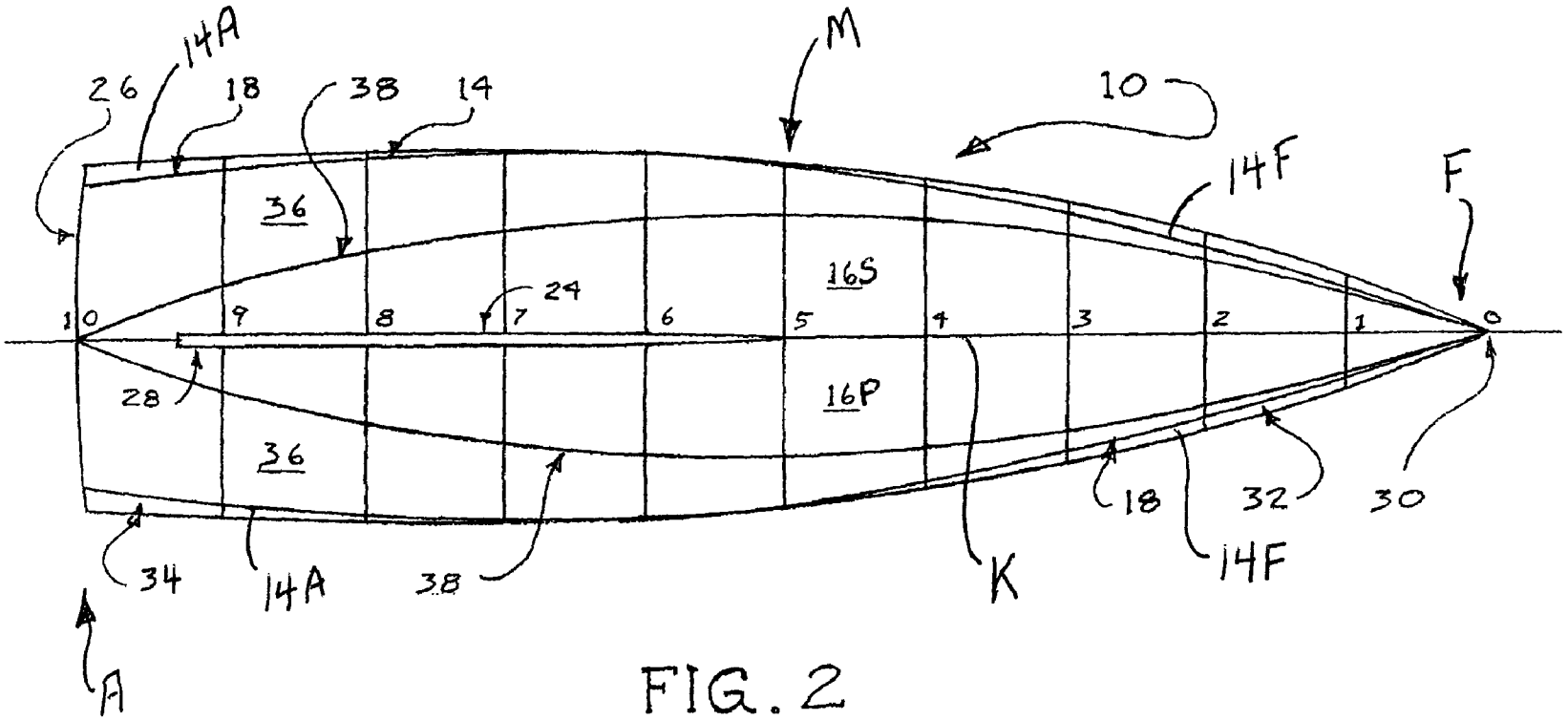
FIG. 2 is a Lines Plan scaled drawing of the inventive compound hull of FIG. 1 in bottom plan view.
Figure 3:
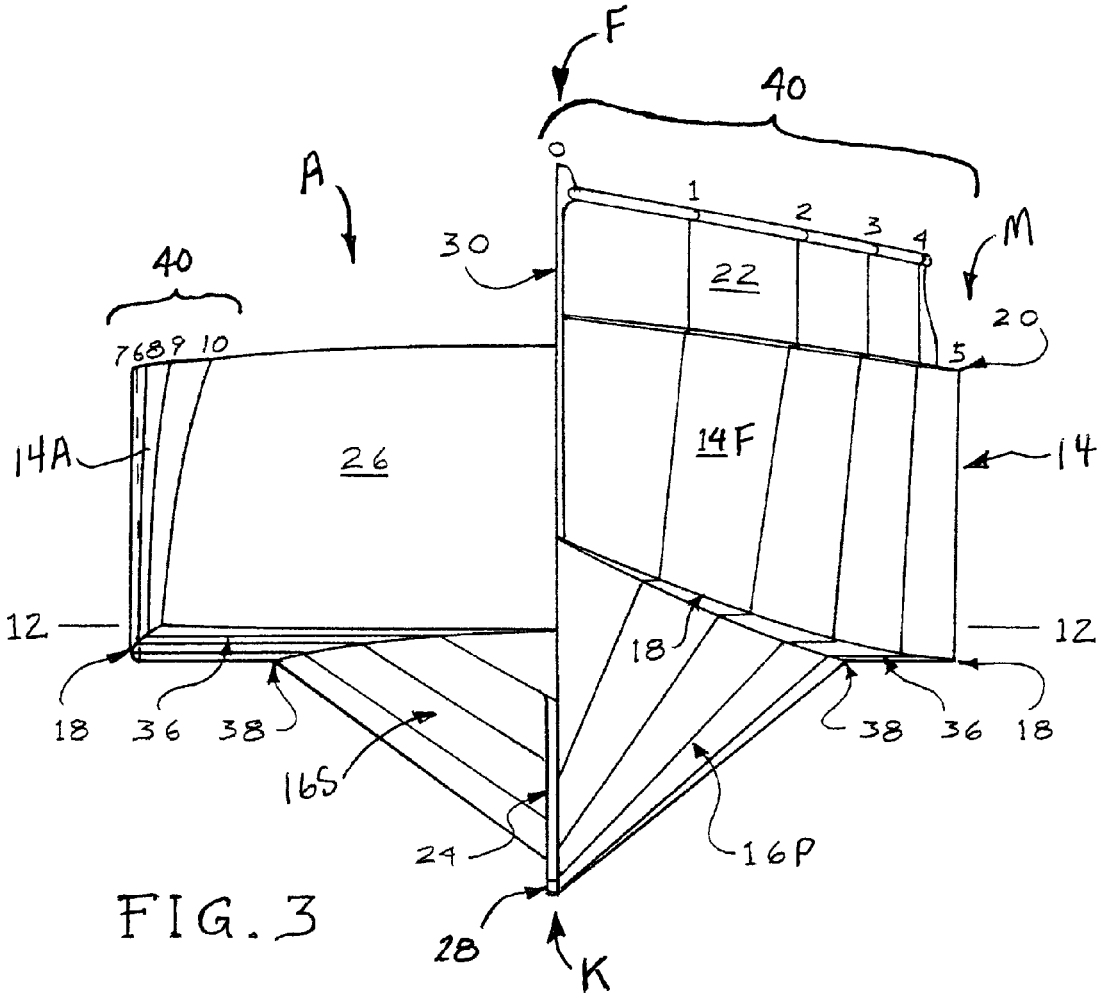
FIG. 3 is a Lines Plan scaled drawing of the inventive compound hull of FIG. 1 in vertical superimposed fore and aft elevation plan view, the right side being the fore view and the left side the aft view.

FIGS. 1-3 are Lines Plan scaled drawings (transparent wire form drawings) of the inventive compound displacement hull scaled to a 40' cruiser vessel in side elevation profile (FIG. 1), in bottom plan view (FIG. 2), in which both top and bottom portions are visible showing the merge of the top portion planar section with the double-ended V-bottom displacement bottom section, and in fore/aft elevation view (FIG. 3), wherein the right side is the fore elevation and the left side is the aft elevation, respectively. The vertical contour lines are spaced from fore to aft in identified Stations 0-10 at 4' intervals.

In FIG. 1, the inventive compound hull 10, shown with its fore, bow end, F, on the right, its aft, stern end A on the left, mid-ship line M amidship, and keel K, is illustrated afloat but not moving on water surface 12; compound hull 10 comprises an upper hull portion 14 mated to a lower hull portion 16. Each upper hull side 14 terminates at its lower margin in a wave form chine 18 and at its upper margin in the sheer 20. The pilot house and salon structures normally mounted atop the deck (not shown) that spans between the port and starboard sheers are not shown, as one skilled in the marine architectural art will recognize that a wide range of both above- and below-deck structures and amenities may be provided, without affecting the hull functionality. By way of example, bulwark 22 may be provided forward, both for aesthetics and as a high wave deflector.

As shown in FIGS. 1-3, a skeg 24 extends aft from amidship Station 5 of the double ended V-bottom lower hull portion 16, terminates short of the transom 26 at the aft end A, and includes a lower rudder bracket 28. The prow, at the fore end F of the vessel, terminates in a stem 30, which, as shown, is vertical on both the upper hull portion 14 and the lower hull portion 16, in this case for the classic cruiser look. However, it should be understood that the stem may be angled forward for a clipper-style bow, or back for a gunboat style bow. Likewise, the transom 26 may be angled forward or back, or may be stepped.

As seen in FIGS. 1 and 2, the aft end transom 26 has a gentle transverse curve, but may be more or less curved, that is, it may vary from straight to more rounded, for design aesthetics or functionality. As best seen in FIGS. 2 & 3, the forward sides 14F of the upper hull exhibit from Stations 0-5.5 a decreasing variable flare (outward taper) 32 from the chine 18 to the sheer 20, while the aft sides 14A of the upper hull exhibit from Stations 5.5-10 an increasing variable tumble home (inward taper) 34 from the chine 18 to the sheer 20. As shown in this exemplary embodiment of the inventive compound hull 10, the upper hull sides 14 from about Stations 4-6 are nearly vertical.

These flare and tumble home tapers or curved side planes of upper hull 14 are optional, but for a cruiser design they are preferred, and may have a wide range of design variations. For example the flare and tumble home may have an arithmetic, geometric or exponential change in value, decrease or increase, respectively, going aft from Station 0, or may be constant or any aesthetically pleasing progression. As shown, the flare and tumble home are consistent with a classic cruiser design.

Figure 4:
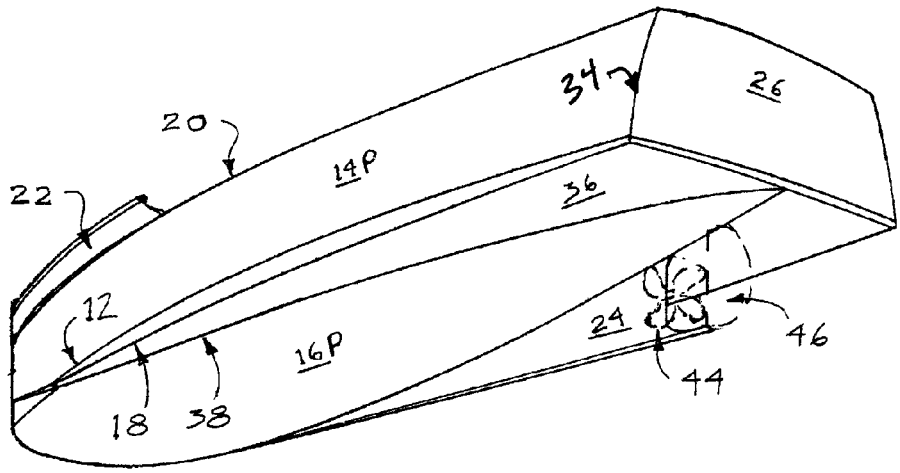
FIG. 4 is an isometric line drawing from the aft port side (stern quarter view) of the inventive compound hull of FIG. 1, and represents a 5' long model, the test results of which are described below.

As best seen in FIGS. 2 and 3 the lower V-hull portion, having sides 16P and 16S, mates to a bottom 36 of the upper hull 14, which bottom extends generally horizontally between the chine 18 and the outer, upper margin 38 of the double-ended lower V-hull portion 16 (an elongated Marquise shape seen in the bottom plan view of FIG. 2). As seen in FIGS. 2 and 3, the area of bottom 36 of the upper hull 14 may be described, for each side of the vessel, as a half-crescent shape, with the point at the stem 30 and the widest portion at the transom 26. Note the sides of the lower V-hull 16 angle outwardly and upwardly from the keel, K, and the beam of the lower hull 16 at all Stations is less than the beam of the upper hull 14, except at the stem 30, where they merge. Likewise, as seen in FIGS. 2 and 4, the stern of both the upper and lower hulls merge at the transom 26; that is, the fore-aft length of the upper hull 14 is the same as that of the bottom V-hull 16. The section of bottom 36 of upper hull 14 that is aft, from approximately the mid-ship M to the stern transom 26, may be described as substantially flat.

As can be seen in more detail in FIGS. 2, 3 and 4, an important aspect of the invention is that the aft section of flat bottom 36 "surfs" downhill from the crest of the stern wave at the design speed of the hull, when properly trimmed (slightly aft of LCG). This recaptures propulsion energy that has been expended in forming the wave as the lower V-bottom hull portion drives through the water. The bottom aft section 36 also provides stability against roll and pitch of the vessel, and damps turbulence, thereby further conserving energy and reducing resistance.

Figure 5:
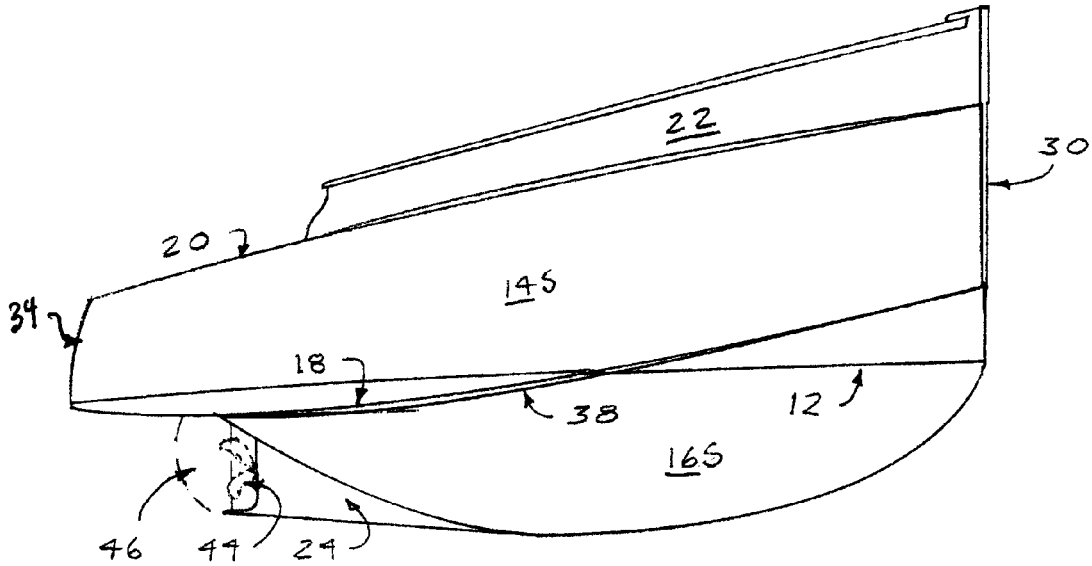
FIG. 5 is an isometric line drawing from the bow starboard side (bow quarter view) of the inventive compound hull of FIG. 1, and represents a 5' long model, the test results of which are described below.

FIGS. 4 and 5 show in isometric a stern quarter view and a bow quarter view, respectively of the inventive compound hull of FIGS. 1-3 with the vessel at rest. The resting water line 12 is superimposed on the port side of the hull in FIG. 4, and on the starboard side in FIG. 5. In these figures, the propeller 44 and the rudder 46 are shown in phantom for context. These figures also more clearly show the faired join line 38 of the bottom section 36 of the upper hull portion 14 (14P in FIG. 4; 14S in FIG. 5) as it is merged with the upper edge of the lower V-hull portion 16 (16P in FIG. 4; 16S in FIG. 5). This merge or join line 38 extends above resting water line from about Station 0 to about Station 2. Note that at rest, the chine 18 is submerged from about Station 2.0 aft to Station 10 and that the bottom of the transom 26 is slightly below the resting water line. The stem 30 extends vertically the full rise of the sides of the upper hull 14 and forms the forward, above resting water line portion of the lower hull portion 16. This inventive compound hull shape was tested as described below.

Experimental Results:

A precise, 5' long scale model of the inventive compound hull of FIGS. 1-5 was constructed for engineering and performance testing in a marine towing tank under certified, controlled conditions. The tank was 67 m long, 3.7 m wide and 2.4 m deep, and the towing carriage and instrumentation is highly sophisticated. A hydraulically driven wave-maker at one end of the tank created the required scale wave heights. Some 19 runs were carried out in the following configurations, the pertinent ones reported in detail below.

FIG. 4 shows the model in stern quarter view and represents accurately the inventive compound hull, including all the elements called out by number above. FIG. 4 shows the flat bottomed stern section 36, the transom 26 and the tumble home taper 34 of the upper hull section and the faired mating join 38 with the lower V-hull portion 16. FIG. 5 is a bow quarter view line drawing of the model. Together FIGS. 3, 4 and 5 show the mating of the upper, flat bottom hull portion to the lower, double-ended V-hull portion along the faired join line 38.

The performance of this model is shown in the attached FIGS. 6-11, and was tested in four basic configurations in calm water resistance runs, shown below in Table 1: Test Configurations, as follows:

TABLE 1

Test Configurations

| Configuration | Run #s | Test of: | Particulars |
|---|---|---|---|
| A | 1-6 | Hull, Test Baseline | 19,000 lbs. Displacement S.W., Level trim |
| B | 7-9 | Hull Design, At Load | 19,000 lbs. Displacement S.W., LCG shifted 1.4% LWL aft of level trim position* |
| C | 10-14 | Hull Design, Light | 17,500 lbs. Displacement. S.W., LCG shifted 1.5% LWL aft of level trim position* |
| D | 15-19 | Hull Design, Overload | 20,500 lbs. Displacement S.W.- level trim |

*2 lb ballast weight shifted 10" aft.

Instrumentation is shown in Table 2: Calm Water Testing Instrumentation, as follows:

TABLE 2

Calm Water Testing Instrumentation

| Measurement | Instrumentation | Units |
|---|---|---|
| Carriage Speed | Carriage Drive Signal | ft/s |
| Model Sinkage | Linear Optical Encoder | inches |
| Heave Post Force | 5" Type Load Cell | lbs |
| Pitch Angle | Rotary Optical Encoder | deg |
| Wave Height | Capacitance Wave Probe | inches |

For the design capacity of 19,000 lbs for the 40' cruiser of this example, the model data and operating constants were as set forth in Table 3: Model Data and Operating Constants, below. The model was towed free-to-trim and free-to-heave, but was restricted to roll and yaw. The towing bracket was attached at the estimate Longitudinal Center of Gravity (LCG). Resistance data was extrapolated to full-scale using standard Froude scalars, and was corrected for parasitic resistance of turbulence simulation studs and for deficit over laminar area forward of the studs. No allowance was made for air resistance, and calculations of EHP are for 64' deep salt water at 59° F.

TABLE 3

| Model Data and Operating Constants | | |
|---|---|---|
| LENGTH OVERALL | 5.00 (ft) | 1.52 (m) |
| LENGTH WATERLINE | 4.95 (ft) | 1.51 (m) |
| BEAM OVERALL | 1.33 (ft) | 0.41 (m) |
| BEAM WATERLINE | 1.32 (ft) | 0.40 (m) |
| DRAUGHT | 0.43 (ft) | 0.13 (m) |
| MIDSECTION AREA | 0.22 ($ft^2$) | 0.02 ($m^2$) |
| DISPLACEMENT | 36.20 (lbs) | 17.86 (kg) |
| MODEL SCALE | 8.00 | |
| TANK WATER TEMPERATURE | 16.00 (° C.) | |
| DENSITY FRESH WATER | 1.94 (lb-sec$^2$/ft$^4$) | |
| VISCOSITY FRESH WATER | 1.19E−05 ($ft^2$/sec) | |
| ROUGHNESS ALLOWANCE | 0.00040 | |

The Configurations A and B, above, were run in the towing tank with the results, shown in Table 4: Measured Model Data for 19,000 lbs (Load) Displacement, below:

TABLE 4

| Measured Model Data for 19,000 lbs (Load) Displacement: | | | | |
|---|---|---|---|---|
| RUN No. | SPEED (ft/sec) | RESIST-ANCE (lbs) | CG RISE (inch) | TRIM CHANGE (deg) |
| Config A 19,000 lbs level trim | | | | |
| 1 | 4.21 | 0.70 | −0.17 | −0.44 |
| 2 | 4.50 | 0.88 | −0.25 | −0.51 |
| 3 | 4.80 | 1.16 | −0.30 | −0.49 |
| 4 | 5.10 | 1.47 | −0.37 | −0.30 |
| 5 | 5.40 | 1.90 | −0.42 | 0.09 |
| 6 | 6.00 | 2.70 | −0.42 | 1.10 |
| Config B 19,000 lbs LCG shifted 1.4% LWL Aft | | | | |
| 7 | 4.18 | 0.72 | −0.19 | −0.33 |
| 8 | 4.79 | 1.12 | −0.29 | −0.31 |
| 9 | 5.37 | 1.82 | −0.41 | 0.23 |

Figure 6A:
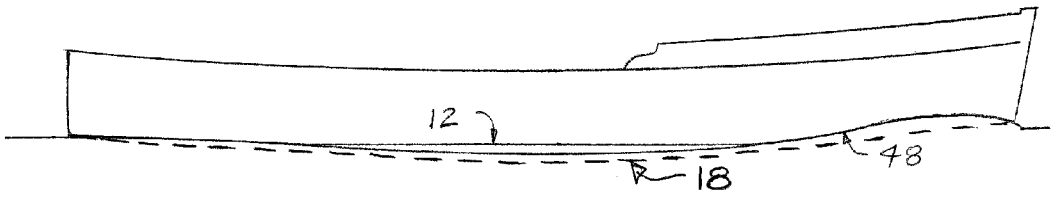
FIG. 6A shows the inventive compound hull running at 7 knots.
Figure 6B:
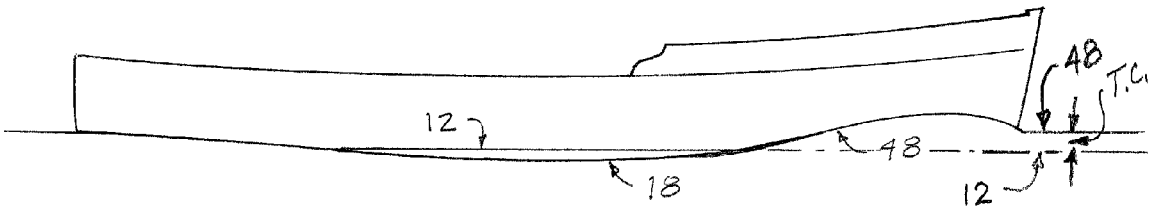
FIG. 6B shows the inventive compound hull running at 8 knots.
Figure 6C:
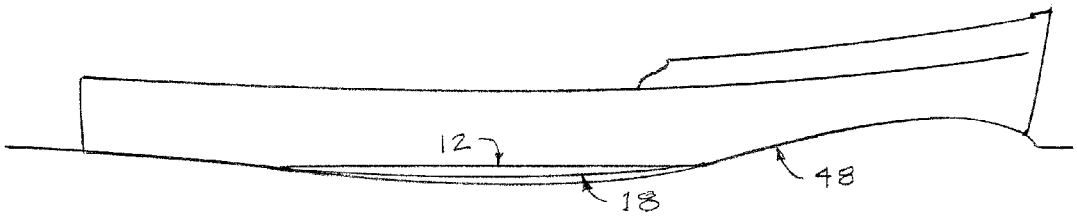
FIG. 6C shows the inventive compound hull running at 9 knots.

In all runs, Wetted Length was 4.98 ft, Wetted Area was 6.63 sq. ft., Laminar Length was 0.69 ft, Laminar Area was 0.26 cubic ft., and Pins=12. As noted, the baseline Config. A runs 1-6 are not shown in the Figures. Config B, the Design Hull at load displacement of 19,000 lbs, Run 7 is shown in FIG. 6A, running at 7 knots; Run 8 is shown in FIG. 6B at hull speed of 8 knots; and Run 9 is shown in FIG. 6C, at 9 knots.

With respect to calculations for full size vessel operations, the following operating constants were used: Open Water Temperature is taken as 15.00 (° C.), Density of salt water is 1.99 (lb-sec2/if4), and the viscosity of salt water is 1.28E-05 ($ft^2$/sec). In all calculations, ITTC 1957 Correlation Line used in calculating Frictional Resistance and Roughness Allowance was taken as 0.00040. The full sized ship constants for the design load of 19,000 lbs, 40' cruiser using the inventive hull design are as follows in Table 5, below.

TABLE 5

| Full Size Ship Constants | | |
|---|---|---|
| LENGTH OVERALL (SHIP) | 40.00 (ft) | 12.19 (m) |
| LENGTH WATERLINE (SHIP) | 39.59 (ft) | 12.07 (m) |
| BEAM OVERALL (SHIP) | 10.64 (ft) | 3.24 (m) |
| BEAM WATERLINE (SHIP) | 10.59 (ft) | 3.23 (m) |
| DRAUGHT(SHIP) | 3.42 (ft) | 1.04 (m) |
| MIDSECTION AREA (SHIP) | 14.05 ($ft^2$) | 1.31 ($m^2$) |
| DISPLACEMENT (SHIP) | 8.50 (L.T.) | 8.63 (tonnes) |
| VOLUME (SHIP) | 297.23 ($ft^3$) | 8.42 ($m^3$) |
| BLOCK COEFFICIENT | 0.21 | |
| PRISMATIC COEFFICIENT | 0.53 | |
| L/B | 3.74 | |
| B/T | 3.10 | |
| D/L | 136.92 | |

The Configurations C (Light, representing 17,500 #) and D (Overload, representing 20,500#) were run in the towing tank, with the following results:

| RUN No. | SPEED (ft/sec) | RESIS-TANCE (lbs) | CG RISE (inch) | TRIM CHANGE (deg) | WETTED LENGTH (ft) | WETTED AREA ($ft^2$) | LAMINAR LENGTH (ft) | LAMINAR AREA ($ft^2$) | PINS |
|---|---|---|---|---|---|---|---|---|---|
| Config C 17,500 lbs. LCG shifted 1.5% LWL Aft | | | | | | | | | |
| 10 | 4.19 | 0.69 | −0.20 | −0.36 | 4.91 | 6.26 | 0.65 | 0.25 | 12 |
| 11 | 4.49 | 0.84 | −0.21 | −0.35 | 4.91 | 6.26 | 0.65 | 0.25 | 12 |
| 12 | 4.78 | 1.11 | −0.25 | −0.27 | 4.91 | 6.26 | 0.65 | 0.25 | 12 |
| 13 | 5.06 | 1.38 | −0.34 | −0.06 | 4.91 | 6.26 | 0.65 | 0.25 | 12 |
| 14 | 5.35 | 1.74 | −0.35 | 0.33 | 4.91 | 6.26 | 0.65 | 0.25 | 12 |
| Config D 20,500 lbs level trim | | | | | | | | | |
| 15 | 4.17 | 0.75 | −0.21 | −0.28 | 5.00 | 6.76 | 0.74 | 0.27 | 12 |
| 16 | 4.47 | 0.94 | −0.24 | −0.24 | 5.00 | 6.76 | 0.74 | 0.27 | 12 |
| 17 | 4.79 | 1.22 | −0.32 | −0.23 | 5.00 | 6.76 | 0.74 | 0.27 | 12 |
| 18 | 5.09 | 1.56 | −0.40 | −0.04 | 5.00 | 6.76 | 0.74 | 0.27 | 12 |
| 19 | 5.36 | 2.00 | −0.45 | 0.27 | 5.00 | 6.76 | 0.74 | 0.27 | 12 |

Figure 7A:
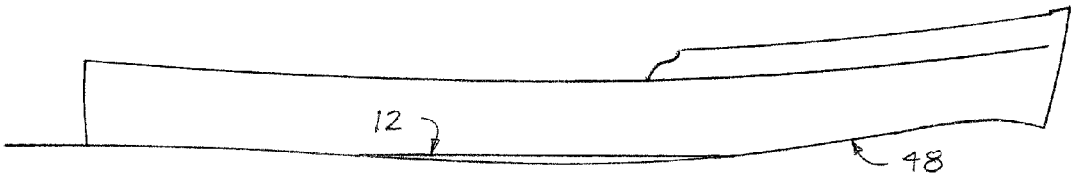
FIG. 7A shows the inventive compound hull running at 7 knots.
Figure 7B:
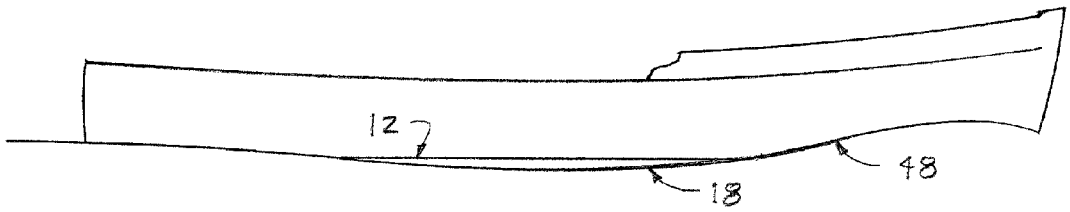
FIG. 7B shows the inventive compound hull running at 8 knots.
Figure 7C:
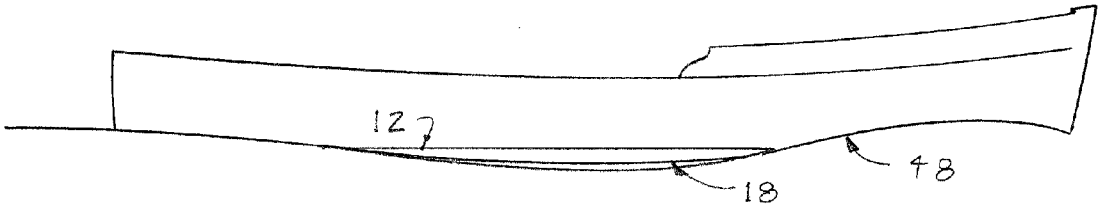
FIG. 7C shows the inventive compound hull running at 9 knots.
Figure 8A:
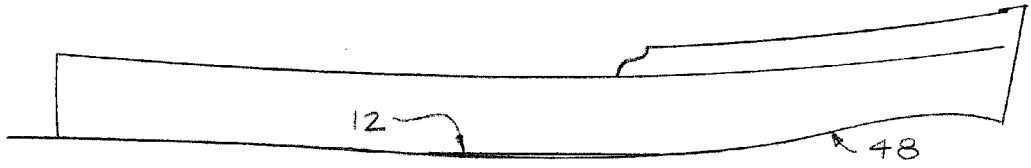
FIG. 8A shows the inventive compound hull running at 7 knots.
Figure 8B:
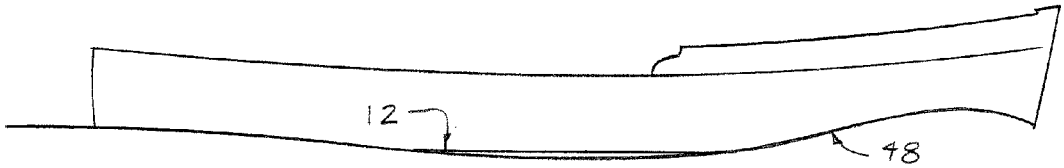
FIG. 8B shows the inventive compound hull running at 8 knots.
Figure 8C:
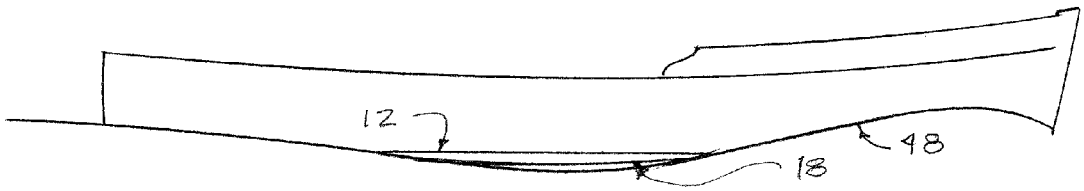
FIG. 8C shows the inventive compound hull running at 9 knots.

Note the Wetted Length, Wetted Area, Laminar Length and Areas are slightly different than for the runs of Configurations A and B (Load, representing 19,000#). Config C (Light, representing 17,500#), Runs 10, 12 and 14, are shown in FIGS. 7A, 7B and 7C, respectively. Config D (Overload, representing 20,500#), runs 15, 17 and 19, are shown in FIGS. 8A, 8B and 8C, respectively.

Discussion of Exemplary Testing Results:

The results of the above calm water resistance run tests show the green energy benefits of the inventive hull design as carried out on the 1:8 scale model of a 40' hybrid-powered bridge deck cruiser. As a result of the baseline testing at displacement load, Config A, the model was trimmed by the stern by moving ballast weights to represent an LCG change of 1.4% of the LWL for the design 19,000 lbs displacement load configuration. This was the configuration for Config B (Load), towing tank Runs 7-9, FIGS. 6A-6C. As can be seen in FIG. 6A, the trough of the tank test wave form 48 forms at 7 knots between Stations 3 and 4 with the chine 18 under the surface the full length of the vessel. In contrast, in FIG. 6B, at hull speed, 8 knots, the trough forms between Stations 4 and 5 and the wave form 42, which is the wave form at 1.3 $\sqrt{LWL}$, follows the chine from about Station 2 to Station 7.5. At 9 knots, FIG. 6C, the trough moves further back to between Stations 5 and 6. As best seen in FIG. 6B, the preferred configuration and speed, the bottom of the upper hull section 36 is surfing in the cresting stern wave, as seen by the lift at the back between Stations 7.5-10. In addition, −½° trim change, TC is shown by the vertical difference between the resting water line 12 and the wave form line 42 at the prow of the vessel. In contrast, in FIG. 6A the stern is not fully supported and in FIG. 6C the aft wave is starting to move beyond the transom, thus some lift is lost. Note also the chine 18 between about Stations 2.5-6.5 is exposed, meaning the double V-hull portion is not providing full displacement, and the amidships portion of the flat bottom are not providing lift. The negative trim change, TC, is also shown on the right in FIG. 1.

Note that in FIG. 1, the theoretical wave form at hull speed is labeled "42", whereas in the actual test runs, the actual wave form surface is labeled "48" in FIGS. 6A-C, 7A-C, and 8A-C.

The model was then run "light" in a 17,500 lb load configuration with the aft ballast trim of Config B, resulting in an LCG change of 1.5% of the LWL. This was the towing tank Config C (Light) Runs 10-14, the runs at 7, 8 and 9 knots (Runs 10, 12 and 14) being shown in FIGS. 7A, 7B and 7C, respectively. Although the response was not as dramatic, the wave form follow of the chine in FIG. 7B is also evident, showing good energy utilization by the inventive compound hull, even when light.

The trim by stern LCG adjustment in Configs B (Load) and C (Light) helped to keep the stern of the vessel fully immersed in the water so the flat bottom of the upper hull portion could surf on the descending portion of the wave created by the lower hull portion as the vessel drove through the water, thereby recycling and conserving energy and resulting in a lower EFH requirement for a vessel of this length and displacement mass.

Finally, the performance was evaluated at overload conditions, 20,500 lbs at level trim (not shifted aft), which was Config D (Overload), Runs 15-19, the runs at 7, 8 and 9 knots (Runs 15, 17 and 19) being shown in FIGS. 8A, 8B and 8C, respectively. Although greater resistance was observed, it showed that the vessel was still stable, albeit not as efficient as design capacity (Config. B (Load), 19,000 lbs for a 40' vessel).

The results are also shown graphically in FIGS. 9-11. FIG. 9 is a graph of Total Resistance vs Speed with the design (Config B) and light (Config C) vessels showing the least resistance at hull speed of 8 knots, and also that the trim by stern gives lower resistance values. The increase in resistance between 7 to 8 knots is on the order of 200 lbs, and increases to over 300 lbs in raising the speed from 8 to 9 knots. FIG. 10 is a graph of Effective HP (EHP), that is, delivered horsepower measured at the propeller vs Speed. This shows that for the design configuration B, EHP needs to double from 6 to 12.5 in raising speed from 7 to 8 knots, but about double that to 25 hp in going to 9 knots. FIG. 11 is a graph of Trim Change vs Speed and shows that the design configuration B begins to rise sharply above 8 knots. Taken together FIGS. 9-11 show that the sweet spot for this vessel is around 8 knots, the displacement hull speed, but at a very low 12.5 EHP, well within the output shaft horse power capacity of currently available marine hybrid power plants, and some 50% less than hulls of different design.

As seen in the preferred example of the inventive compound hull, FIGS. 1-3, the beam of the lower hull portion at mid-ship is about 0.66 of the beam of the upper hull portion. The lower hull portion beam may typically range from about 0.5 to about 0.8 the beam of the upper hull portion, and more preferably in the range of about 0.6 to about 0.7 the beam of the upper hull portion.

INDUSTRIAL APPLICABILITY

It is clear that the inventive hull design of this application has wide applicability to the marine industry, namely to power cruisers, and more particularly to electric-powered and hybrid powered vessels. The combination of double ended V-bottom lower hull plus flat-bottom, square-transom upper hull having a chine set to match the vessel wave form at hull speed clearly provides unexpected power efficiencies and recycle of energy. The resulting vessel provides features of stability and efficiency that make it ideal for hybrid power in recreational cruisers. Thus, the inventive hull has the clear potential of becoming adopted as the new standard for recreational, research and work vessel power cruisers. One skilled in this art will clearly understand that the inventive compound hull configuration can be adapted to hulls of any particular length and beam for a particular use.

It should be understood that various modifications within the scope of this invention can be made by one of ordinary skill in the art without departing from the spirit thereof and without undue experimentation. For example, the upper, above-deck cabin and interior amenities layout can be provided in a wide range of designs to provide the functionalities desired by owners and users. Likewise the length, draft, freeboard and beam of a vessel using the inventive hull design may be widely varied within the scope of the invention. This invention is therefore to be defined by the scope of the appended claims as broadly as the prior art will permit, and in view of the specification if need be, including a full range of current and future equivalents thereof.

The invention claimed is:

1. A compound hull for powered vessels having a fore end prow, an aft end stern, a mid-ship line, a keel and developing a wave form at displacement hull speed, defined as the wave shape formed by a lower hull at a speed at which the wave length matches the waterline length of the vessel and develops a crest adjacent said stern, comprising:

a) a displacement hull having:

i) an upper hull portion having a bottom and hull sides joined at a stem at said vessel fore end and terminating at said vessel aft end in a generally square stern, said bottom having a generally flat aft section extending from said mid-ship line to said stern, each said hull sides having a top edge which forms a sheer and a bottom curve which joins said bottom along a hard chine; said bottom aft section of said upper hull matching said wave form at hull speed from said mid-ship line to said stern, said bottom flat aft section providing a plane on which said hull surfs on the developing crest of said wave form; and ii) a lower hull portion consisting of a pair of angled side planes joined continuously along a bottom keel margin from said fore end to said aft end which together form a double ended V-bottom displacement hull having a varying dead-rise angle, a length the same as said upper hull portion and a beam less than the beam of the upper hull portion;

b) said upper and said lower hull portions being joined along a faired line that begins at said fore end of said vessel at said intersection of said hard chine and said stem and terminates at a midpoint of said stern; and c) said upper and said lower hull portions cooperate to recover energy from said wave form by surfing downhill on the developing crest of said wave form thereby resulting in lower power requirements for long-period cruising at displacement hull speed while providing greater aft beam and load capacity, as compared to compound hull shapes not having a double ended V-bottom displacement lower hull portion, and said bottom flat aft section with square stern providing stability against roll and pitch of said vessel and damping turbulence.

2. A compound hull as in claim 1 wherein said lower hull portion includes a skeg extending aft from adjacent said mid-ship line.

3. A compound hull as in claim 1 wherein said upper hull portion stem is oriented at an angle ranging from acute to vertical.

4. A compound hull as in claim 1 wherein said upper hull portion includes sidewalls between said chine and said sheer that have at least one of a flare and a tumble home along a portion between the stem and the stern.

5. A compound hull as in claim 4 wherein said flare is disposed in said upper hull sidewalls between the stem to about said mid-ship line, and said tumble home is disposed in the upper hull sidewalls between about said mid-ship line to the stern.

6. A compound hull as in claim 1 which is powered to provide a cruising speed ranging ±2 knots of said displacement hull speed of said vessel.

7. A compound hull as in claim 6 wherein said hull is 40-60' in length, and said displacement hull speed is 8-12 knots.

8. A compound hull as in claim 1 wherein the beam of said lower hull portion is from about 0.5 to about 0.8 of the beam of the upper hull portion at mid-ship.

9. A compound hull as in claim 8 wherein the beam of said lower hull portion is in the range of about 0.6 to about 0.7 of the beam of the upper hull portion at mid-ship.

10. A compound hull as in claim 9 wherein the beam of said lower hull portion is about 0.66 of the beam of the upper hull portion at mid-ship.

11. A compound hull as in claim 1 which includes a bulwark mounted on said upper hull portion extending aft from said stem to short of said mid-ship.

12. A compound hull as in claim 6 wherein said lower hull portion includes a skeg extending aft from approximately said mid-ship line.

13. A compound hull as in claim 12 wherein the beam of said lower hull portion is in the range of from about 0.5 to about 0.8 of the beam of the upper hull portion at mid-ship.

14. A compound hull as in claim 13 which is powered by a hybrid power system sized to provide a cruising speed ranging ±2 knots of displacement hull speed for the vessel length.

15. A compound hull as in claim 14 wherein said hull is 40-60' in length.

16. A compound hull as in claim 15 wherein the displacement hull speed is 8-12 knots.

17. A compound hull as in claim 16 wherein said upper hull portion stem is oriented at an angle to the horizontal ranging from acute to vertical.

18. A compound hull as in claim 17 wherein said upper hull includes sidewalls between the chine and the sheer that have at least one of a flare and a tumble home along a portion between the stem and the transom.

* * * * *